US011821240B2

(12) United States Patent
Justitz

(10) Patent No.: US 11,821,240 B2
(45) Date of Patent: Nov. 21, 2023

(54) PLATFORM AND PALLET STORAGE SECURITY SYSTEM

(71) Applicant: James M. Justitz, San Antonio, TX (US)

(72) Inventor: James M. Justitz, San Antonio, TX (US)

( * ) Notice: Subject to any disclaimer, the term of this patent is extended or adjusted under 35 U.S.C. 154(b) by 14 days.

(21) Appl. No.: 17/811,331

(22) Filed: Jul. 8, 2022

(65) Prior Publication Data

US 2022/0372797 A1 Nov. 24, 2022

Related U.S. Application Data

(63) Continuation-in-part of application No. 17/303,144, filed on May 21, 2021.

(51) Int. Cl.
*E05B 67/00* (2006.01)
*B65D 19/38* (2006.01)

(52) U.S. Cl.
CPC ..... *E05B 67/003* (2013.01); *B65D 19/38* (2013.01); *B65D 2211/00* (2013.01); *B65D 2519/00273* (2013.01)

(58) Field of Classification Search
CPC .... E05B 67/003; E05B 73/00; E05B 73/0005; E05B 73/0011; E05B 65/00; B65D 71/0092; B65D 71/0096; B65D 71/06; B65D 19/385; B65D 19/44; B65D 19/38; B65D 25/0081; B65D 2519/00273; B65D 2211/00; B60P 7/083
USPC ..... 211/41.14, 41.15, 41.16
See application file for complete search history.

(56) References Cited

U.S. PATENT DOCUMENTS 199,468 A * 1/1878 Rheubottom ..... E05B 67/003 70/49
343,849 A * 6/1886 Pond ..... G09F 3/0352 24/23 R
437,548 A * 9/1890 Anderson ..... D06F 53/00 24/127
886,905 A * 5/1908 Ward ..... B65D 63/14 24/127
895,403 A * 8/1908 Jackson ..... B65D 63/14 24/127
1,550,745 A 8/1925 Rehman
1,940,186 A * 12/1933 Romine ..... B66C 1/10 410/38
2,065,650 A * 12/1936 Burke ..... B65D 71/0096 410/35
2,839,198 A * 6/1958 Lefevre ..... B65G 49/062 206/451

(Continued)

*Primary Examiner* — Patrick D Hawn
(74) *Attorney, Agent, or Firm* — Carson Patents; Gregory D Carson

(57) ABSTRACT

The platform and pallet storage security system is a device or apparatus in the form of a lockable security box with attached cables, cords, chains, and/or straps for securing to prevent theft from stacks or piles of materials or products stored, stowed, or placed on devices such as platforms, pallets, and crates in the material transport and stowage arts. The device or apparatus is made of tamper resistant metal and designed to fit the edges or sides of palletized materials which are connected to and secured to each other around and across the surface of said palletized materials so as to enable the securing of said palletized materials thereby preventing or resisting the theft of the secured materials.

3 Claims, 2 Drawing Sheets

(56) References Cited

U.S. PATENT DOCUMENTS 2,870,980 A * 1/1959 Higgins ..... B65D 19/0095 211/186
3,307,691 A * 3/1967 Vallebona ..... B65D 85/48 206/451
3,416,652 A * 12/1968 Almasy ..... B65D 71/04 206/453
3,443,831 A * 5/1969 Grange ..... B66C 1/28 294/67.41
3,633,937 A * 1/1972 Hlinsky ..... B60P 7/083 410/103
3,645,389 A * 2/1972 Castiaux ..... B65G 49/061 206/454
3,709,358 A * 1/1973 Andrews ..... B65D 71/0092 206/451
3,817,064 A * 6/1974 Sallee ..... E05B 73/0005 70/58
3,834,825 A * 9/1974 Dubois ..... E05B 73/0005 59/93
3,927,764 A * 12/1975 Fox ..... B65D 85/48 206/451
3,938,660 A * 2/1976 Moehring ..... B65D 19/08 206/451
3,939,677 A * 2/1976 Drayton ..... E05B 73/0005 70/14
4,057,982 A * 11/1977 Drayton ..... E05B 73/0005 24/116 R
4,092,815 A * 6/1978 Rowley ..... B65G 49/062 53/399
4,107,958 A * 8/1978 Manley, Jr. ..... E05B 73/00 211/8
4,135,655 A * 1/1979 Brown ..... B65G 7/12 D3/315
4,156,498 A * 5/1979 Miller ..... B44D 3/185 206/451
4,305,505 A 12/1981 Hickey
4,730,734 A 3/1988 Dwelley et al.
4,890,560 A 1/1990 Good
5,259,524 A 11/1993 Eckert
5,297,485 A 3/1994 Bond
5,441,322 A * 8/1995 Jobmann ..... B66C 1/422 294/90
5,678,691 A * 10/1997 Amado-Aguilar ... B65D 81/057 206/451
5,687,455 A * 11/1997 Alexander ..... B65D 63/1072 24/593.11
5,842,424 A 12/1998 Prevot et al.
5,960,652 A * 10/1999 Marmstad ..... E05B 73/0011 70/30
6,216,607 B1 4/2001 Cuddy
6,250,655 B1 * 6/2001 Sheeks ..... B62B 3/108 280/652
6,276,285 B1 8/2001 Ruch
6,622,532 B2 * 9/2003 Hsu ..... G06F 1/181 248/316.4
6,929,438 B1 * 8/2005 Foster ..... B61D 45/001 410/46
6,945,516 B1 * 9/2005 Scott ..... B60P 7/0861 254/237
7,059,819 B2 6/2006 Brackmann et al.
7,073,828 B2 * 7/2006 Foigel ..... G09F 3/0352 292/307 R
7,210,579 B2 * 5/2007 Fujioka ..... B65D 71/04 206/451
7,303,102 B2 * 12/2007 Werts ..... A45F 5/12 224/250
7,311,484 B2 * 12/2007 Facey ..... B60P 7/083 410/100
7,497,100 B2 3/2009 Fawcett et al.
7,934,894 B1 * 5/2011 Temple ..... B65D 71/02 410/97
7,997,213 B1 8/2011 Gauthier et al.
8,317,243 B2 * 11/2012 Emond ..... B66C 1/10 294/90
8,499,595 B2 * 8/2013 Zhang ..... G08B 13/1463 70/57.1
8,640,632 B1 2/2014 Odle et al.
9,169,670 B2 * 10/2015 Shute ..... E05B 73/0017
9,333,978 B2 * 5/2016 Lato ..... B60P 7/0876
9,701,503 B2 * 7/2017 Yamada ..... B65H 31/26
10,065,780 B1 9/2018 Jain
10,352,068 B2 * 7/2019 Hollis ..... E05B 67/006
10,472,167 B2 * 11/2019 Steinert ..... B65D 19/44
10,550,609 B2 * 2/2020 Llewellyn ..... B63B 25/28
10,604,333 B2 * 3/2020 Bradford ..... B65D 85/68
10,926,921 B2 * 2/2021 Rølund ..... B65D 19/385
10,954,052 B2 * 3/2021 Jette ..... B31D 5/006
10,968,011 B1 * 4/2021 Boyk ..... B65D 19/40
11,371,266 B2 * 6/2022 Lin ..... E05B 67/003
11,377,876 B2 * 7/2022 Levavi ..... E05B 47/0038
11,459,800 B2 * 10/2022 Carreon ..... E05B 73/0029
11,479,159 B1 * 10/2022 Kaski ..... B60P 7/083
2004/0016373 A1 1/2004 Bodde et al.
2008/0019788 A1 1/2008 Clarke
2009/0000983 A1 1/2009 Kiolbasa
2009/0241809 A1 10/2009 Head
2014/0109361 A1 * 4/2014 Helline ..... B60P 7/083 24/68 CD
2020/0369197 A1 * 11/2020 Lin ..... B60P 7/0807
2021/0155372 A1 * 5/2021 Boyk ..... B65D 19/40
2022/0048685 A1 2/2022 Justitz
2022/0274753 A1 * 9/2022 Wang ..... B65B 13/02
2023/0049274 A1 * 2/2023 Conner, Jr. ..... F16G 11/12
2023/0182982 A1 * 6/2023 McGrath ..... B65D 71/0096 206/597
2023/0271750 A1 * 8/2023 Tattam ..... B65D 71/0096 206/597

* cited by examiner

PLATFORM AND PALLET STORAGE SECURITY SYSTEM

CROSS-REFERENCE TO RELATED APPLICATIONS

This application claims benefit to the earlier filing date and right of priority for all relevant matter of 35 U.S.C. § 120 to patent application Ser. No. 17/303,144 for Platform Security System by the same inventor, James M. Justitz filed on 21 May 2021, under Carson Patents Docket Number 188JJ-P0002, the contents of which are herein incorporated by reference under 37 CFR 1.57(b).

BACKGROUND OF THE INVENTION

Technical Field

This invention relates generally to a platform and pallet storage security system in the form of a lockable security box with attached cables, cords, chains, and/or straps for securing to prevent theft from stacks or piles of materials or products stored, stowed, or placed on devices such as platforms, pallets, and crates in the material transport and stowage arts.

This invention relates generally to a platform and pallet storage security system in the form of a lockable security box with attached cables, cords, chains, and/or straps for securing to prevent theft from stacks or piles of materials or products stored, stowed, or placed on devices such as platforms, pallets, and crates in the material transport and stowage arts for construction materials.

This invention relates generally to adjustable security devices and apparatuses in the form of security boxes with adjustable length attached cables, cords, chains, and/or straps for securing to prevent theft from stacks or piles of materials or products of various heights and configurations when stored, stowed, or placed on devices such as platforms, pallets, and crates that are capable of securing stacks or piles of materials or products to devices such as platforms, pallets, and crates of any height, width, or depth needed to secure materials or products to platforms, pallets, and crates in the art of material storage and/or transport.

This invention relates specifically to adjustable security devices and apparatuses in the form of security boxes with adjustable length attached cables, cords, chains, and/or straps for securing to prevent theft from stacks or piles of materials or products of various heights and configurations when stored, stowed, or placed on devices such as platforms, pallets, and crates that are capable of securing stacks or piles of materials or products to devices such as platforms, pallets, and crates of any height, width, or depth needed to secure materials or products to platforms, pallets, and crates in the art of construction material storage and/or transport.

This invention relates generally to an adjustable pallet clamp security system in the form of an adjustable locking apparatus for securing pallets of materials to be stored on a construction site.

Background Art

Reusable packing and shipping devices such as pallets, crates, trays, boxes, etcetera are used in the shipping of goods such as construction materials and retail products. Such packing and shipping devices are often left unattended in open areas where they are exposed to theft or damage.

Building materials such as lumber are often similarly left exposed in construction areas and are favorite targets of theft and vandalism.

When there is a need or want to secure materials and prevent theft and injury construction materials can be supervised, moved to a secure container, or enclosed by a secure barrier to surround materials and products. All of these solutions are expensive in human time and costs of relocation and/or additional construction. There are physical containers having lockable doors, and large cumbersome covers available to secure materials and products on pallets and platforms. Again all are expensive and require time and movement of materials to be effective.

There is a need for a system or apparatus to secure materials packed, shipped, and stored on pallets that is quick, adjustable, and secure to better enable securing materials, specifically for securing construction materials present on construction sites and lay-down yards.

BRIEF SUMMARY OF THE INVENTION

According to a first aspect of the invention there is a platform storage security device comprising a security box having a back panel having a top end opposite a bottom end and a left side opposite a right side, a left wall having a first flat edge connected lengthwise to said left side and a first "L" shaped edge having a first flat length and a first elevated length with a first triangular plate having a first edge, a second edge, and a third edge attached lengthwise with said first edge positioned over at least half of said first flat length with a first elevated wall attached along said second edge, and a second elevated wall attached along said third edge connected to said first elevated wall, a right wall having a second flat edge connected lengthwise to said right side and a second "L" shaped edge having a second flat length and a second elevated length with a second triangular plate having a fourth edge, a fifth edge, and a sixth edge attached lengthwise with said fourth edge positioned over at least half of said second flat length with a third elevated wall attached along said fourth edge, and a fourth elevated wall attached along said sixth edge connected to said third elevated wall, a top plate attached at a right angle to said back panel at said top end, a tensioning chamber having a washer with a bolt hole attached internally proximal to one end attached lengthwise to said top plate perpendicular to said back panel, a locking tab having a slot positioned in a first center of said back panel at a clockwise angle between five and eighty-five degrees, and a chain pole attached perpendicular proximate to said bottom end, a cover plate having a top edge, a bottom edge, a locking tab slot through said cover plate at a second center, a bolt hole through said cover plate proximal to said top edge, and a chain pole hole through said cover plate proximate to said bottom edge, a chain having a free end opposite a tightening end comprising a chain tensioner having a threaded bolt dimensioned to pass through said washer extending perpendicular therefrom, and a threaded nut dimensioned to fit within said tensioning chamber but not through said bolt hole for advancing along said threaded bolt for the purpose of securing materials, construction materials, and products to pallets, platforms, and crates to prevent theft of these items when stored and secured with the present invention on a pallet, platform, or crate.

According to a second aspect of the invention there is a platform storage security device comprising a security box further comprising a padlock for the purpose of securing materials, construction materials, and products to pallets, platforms, and crates to prevent theft of these items when stored and secured with the present invention on a pallet, platform, or crate.

According to a third aspect of the invention there is a method of using a platform storage security device comprising a method of securing a stack of materials on a platform using a platform storage security device comprising these steps: 1. Wrapping a chain having an end link on one end and a threaded bolt and a chain tensioner on an opposite end completely around said stack of materials; 2. Placing a security box a locking tab with a slot therethrough over an edge of said stack of materials; 3. placing said end link of said chain over a chain pole of said security box; 4. Inserting said threaded bolt into and through a tensioning chamber of said security box; 5. Threading a nut along said threaded bolt to tighten said chain; 6. Placing a cover plate over said threaded bolt, said locking tab, and said chain pole; 7. Passing a shackle of a padlock through said slot; and 8. Locking said padlock. This method is used for the purpose of securing materials, construction materials, and products to pallets, platforms, and crates to prevent theft of these items when stored and secured with the present invention on a pallet, platform, or crate.

An advantage of the platform storage security device is the adjustability of securing various types, kinds, configurations, and volumes of materials, construction materials, tools, and products enabling the ability to secure quickly and inexpensively nearly any amount or quantities of materials, tools, or products.

The invention will now be described, by way of example only, with reference to the accompanying drawings in which:

DETAILED DESCRIPTION

The detailed embodiments of the present invention are disclosed herein. The disclosed embodiments are merely exemplary of the invention, which may be embodied in various forms. The details disclosed herein are not to be interpreted as limiting, but merely as the basis for the claims and as a basis for teaching one skilled in the art how to make and use the invention.

References in the specification to "one embodiment," "an embodiment," "an example embodiment," etcetera, indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

Furthermore, it should be understood that spatial descriptions (e.g., "above," "below," "up," "left," "right," "down," "top," "bottom," "vertical," "horizontal," etc.) used herein are for purposes of illustration only, and that practical implementations of the structures described herein can be spatially arranged in any orientation or manner.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

Throughout this specification, the words or phrase "tensioning chamber" or variations thereof such as "tensioning tube" or "tensioning cylinder", will be understood to imply the inclusion of an empty cylinder having open ends dimensioned to enable a chain to pass through which has at least one washer positioned internally perpendicular to said cylinder so that it reduces the dimension of the opening of the cylinder to the dimension of the opening in the washer.

Figure 1:
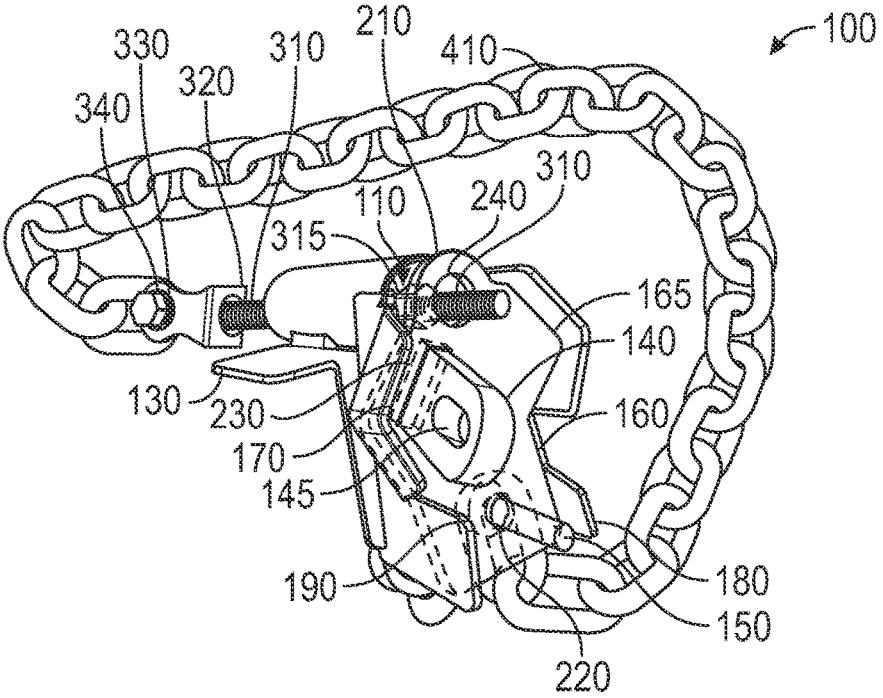
FIG. 1 is a perspective view of the box, cover plate, and chain assembled with the tensioning nut under the cover plate according to the invention.
Figure 2:
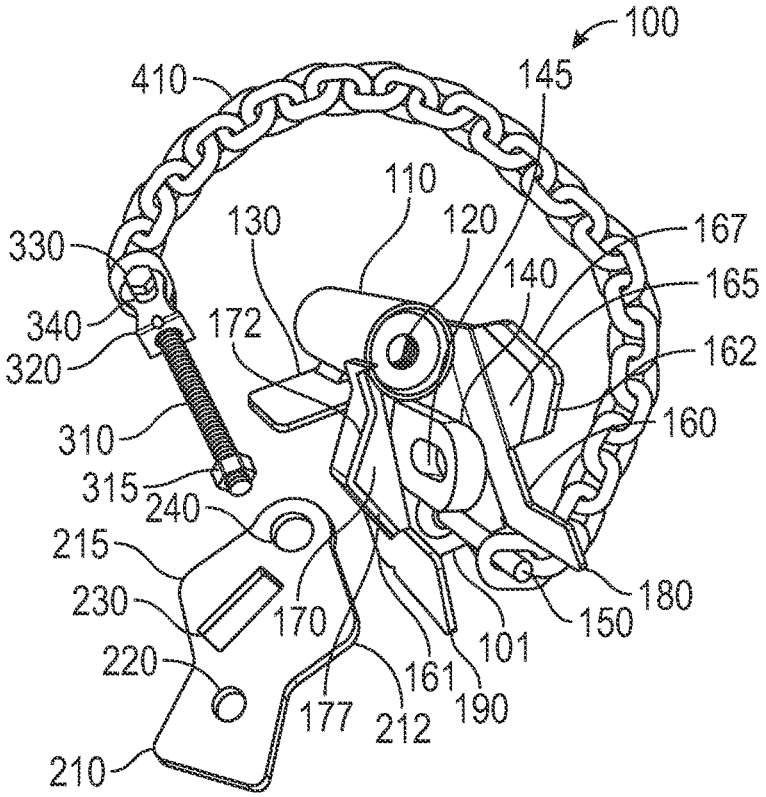
FIG. 2 is a perspective view of the box, cover plate, and chain un-assembled with the tensioning nut on the tensioning bolt according to the invention.
Figure 3:
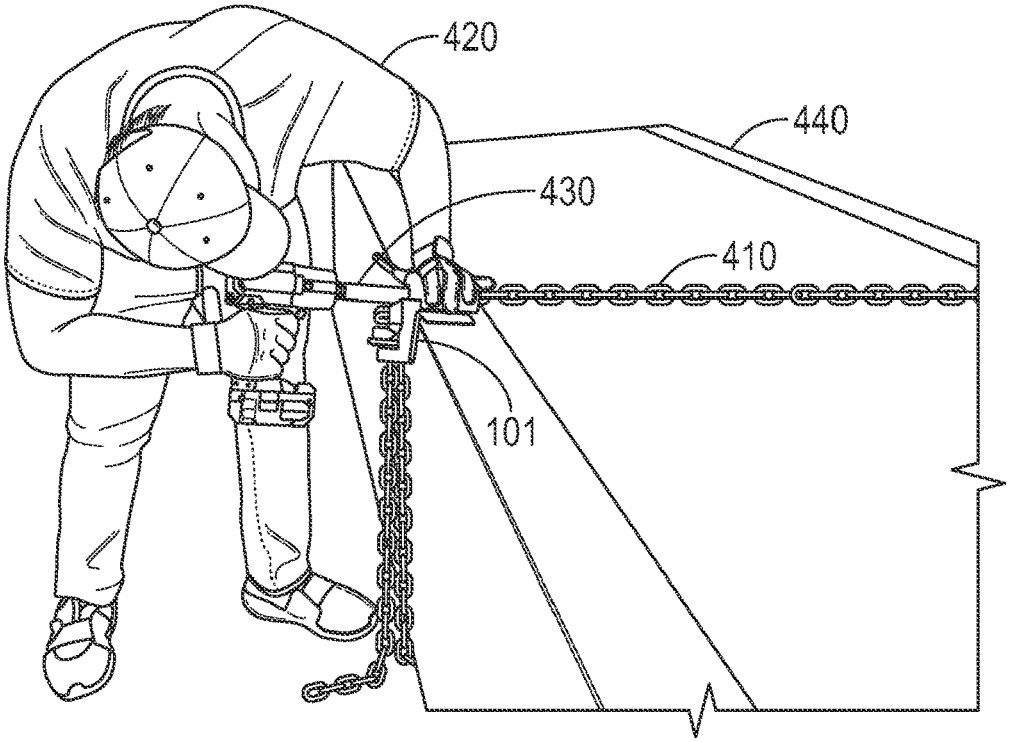
FIG. 3 a perspective view of a platform (pallet) of stacked materials with the platform storage security device attached surrounding the material on said platform (pallet) and a worker tightening the tensioning nut to secure the stacked materials on the platform (pallet) according to the invention.
Figure 4:
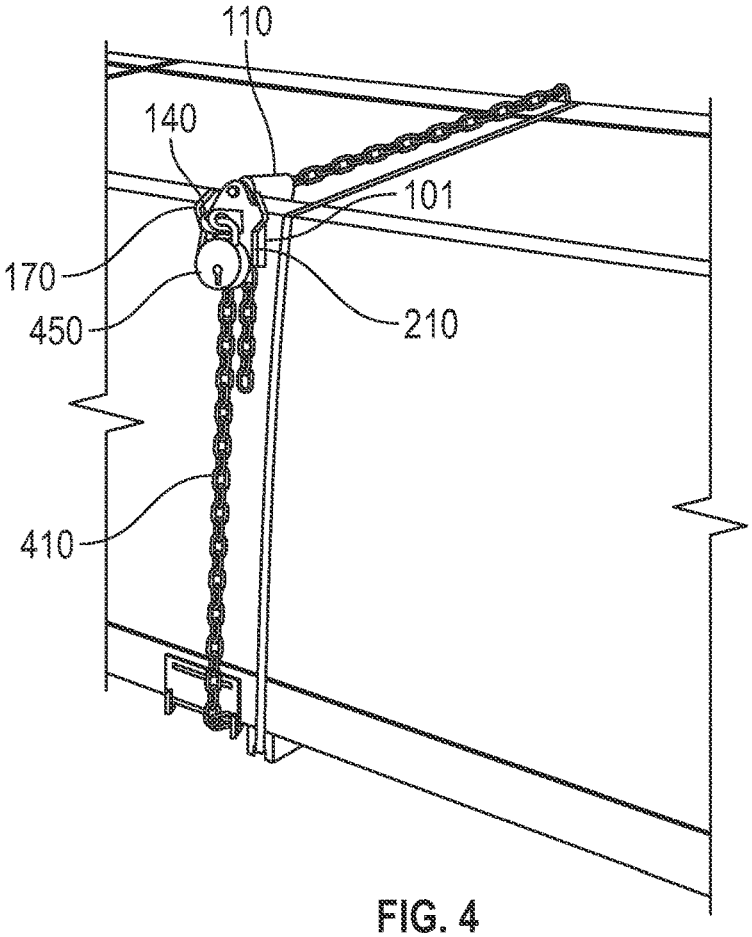
FIG. 4 a perspective view of a platform (pallet) of stacked materials with the platform storage security device padlocked and securing the stacked materials on the platform (pallet) according to the invention.

Features are listed in numeric order. Referring to the Figures, there is shown in FIGS. 1, 2, 3, and 4 the following features:

Element 100 which is a platform and pallet storage security system device.

Element 101 which is a security box.

Element 110 which is a tensioning chamber.

Element 120 which is a washer.

Element 130 which is a top plate.

Element 140 which is a locking tab.

Element 145 which is a slot though the locking tab 140.

Element 150 which is a chain pole.

Element 160 which is an "L" shaped wall.

Element 161 which is an "L" shaped wall.

Element 162 which is an elevated wall.

Element 165 which is a triangular plate.

Element 167 which is an elevated wall.

Element 170 which is a triangular plate.

Element 172 which is an elevated wall.

Element 177 which is an elevated wall.

Element 180 which is an elevated length along the "L" shaped wall 160.

Element 190 which is an elevated length along the "L" shaped wall 161.

Element 210 which is a cover plate.

Element 212 which is a cover plate triangular.

Element 215 which is a cover plate triangular.

Element 220 which is a chain pole through hole.

Element 230 which is a locking tab through hole.

Element 240 which is a bolt pass through hole.

Element 310 which is a threaded bolt.

Element 315 which is a threaded nut.

Element 320 which is a chain tensioner threaded end.

Element 330 which is a chain tensioner chain link slot.

Element 340 which is a chain attachment bolt and nut (nut not shown).

Element 410 which is a security chain.

Element 420 which is a worker.

Element 430 which is a nut tightening device being used by a worker to tighten a nut.

Element 440 which is a platform having stacked materials thereon.

Element 450 which is a padlock.

The device of the present invention is generally made from metal materials because those are the materials relied upon in the art of physically securing loose items. However, any materials suitably resistant to tampering are suitable for implementing the present invention. Metal materials are more tamper resistant and thus more secure than other more easily altered, cut, or broken materials. There are however, all manor of manufactured materials that are suitable for the purpose of resisting tampering are suitable for making the device of the present invention.

The device or apparatus of the present invention can be embodied as herein described with metal parts welded together. Alternatively, some or all of the elements can be combined into molded parts thereby obviating the need for attaching elements that are combined when molded together into a single more complex element.

In a preferred embodiment of the present invention, there is a platform storage security device comprising a metal security box having a metal back panel having a top end opposite a bottom end and a left side opposite a right side, a metal left wall having a first flat edge connected by welding lengthwise to said left side and a first "L" shaped edge having a first flat length and a first elevated length with a first triangular plate having a first edge, a second edge, and a third edge attached lengthwise with said first edge positioned over at least half of said first flat length with a first elevated wall attached along said second edge, and a second elevated wall attached along said third edge connected to said first elevated wall, a metal right wall having a second flat edge connected by welding lengthwise to said right side and a second "L" shaped edge having a second flat length and a second elevated length with a second triangular plate having a fourth edge, a fifth edge, and a sixth edge attached lengthwise with said fourth edge positioned over at least half of said second flat length with a third elevated wall attached along said fourth edge, and a fourth elevated wall attached along said sixth edge connected to said third elevated wall, a metal top plate attached by weld at a right angle to said back panel at said top end, a metal tensioning chamber (open metal tube) having a metal washer with a bolt hole attached internally by weld or pressure fitting proximal to one end attached lengthwise to said top plate perpendicular to said back panel, a metal locking tab having a slot positioned and connected by weld in a first center of said back panel at a clockwise angle between five and eighty-five degrees, and a metal chain pole attached by weld perpendicular proximate to said bottom end, a metal cover plate having a top edge, a bottom edge, a locking tab slot through said cover plate at a second center, a bolt hole through said cover plate proximal to said top edge, and a chain pole hole through said cover plate proximate to said bottom edge, a chain, cable, cord, or strap having a free end opposite a tightening end comprising a chain tensioner having a threaded bolt dimensioned to pass through said washer extending perpendicular therefrom, and a threaded nut dimensioned to fit within said tensioning chamber but not through said bolt hole for advancing along said threaded bolt.

In a preferred embodiment of the present invention, there is a platform storage security device further comprising a padlock.

The security box has a back plate and a tensioning chamber attached at a right angle to each other forming an edge inside a corner of the back of the security box. This corner is positioned over an edge of a stack of materials. A chain with a tensioner attached at one end is wrapped around a stack of materials on a pallet or platform incorporating the pallet or platform therein. The elements of the present invention can be attached by welding when made of metals, and maybe already attached when molded together into a single more complex element.

The tensioning chamber has a washer installed internally that is used to pass a threaded bolt through which then enables a nut to be placed over said thread bolt and tightened along said threaded bolt thereby removing any slack in an attached chain, cable, or strap and enabling said chain, cable, or strap to be tightened thereby restricting the movement of any materials or products within the length of the chain, cable, or strap. Once this method has bound the items on a platform or pallet together a cover plate is placed over the nut wherein the bolt passes through an opening in the cover plate, but the opening will not pass the nut.

When in use, the three openings in the cover plate pass narrowly over the opening of the tensioning chamber, a locking tab with a slot therethrough, and a chain pole. This enables the cover plate to mechanically prevent access to the adjustable nut as well as access to the end link of a chain or cable, cord, or strap and offering a locking tab where a shackle of a pad lock or other locking mechanism to pass through and prevent removal of the cover plate.

In a preferred embodiment of the present invention, there is a method of securing a stack of materials on a platform using a platform storage security device comprising the following steps:

1. Wrapping a chain having an end link at a free end and a threaded bolt and an adjustable chain tensioner at an opposing end completely around said stack of materials so that said free end and said opposing ends are proximal to each other and wrapped around said stack of materials;
2. Placing a security box having a tensioning chamber, a locking tab with a slot therethrough, and a chain pole over an edge of said stack of materials such that said tension chamber, locking tab, and chain pole are perpendicular to said stack of materials pointing away therefrom;
3. Placing said end link of said chain over said chain pole of said security box such that the chain pole passes through the opening through the center of the end link;
4. Inserting said threaded bolt into and through said tensioning chamber of said security box;
5. Threading a nut along said threaded bolt to tighten said chain by advancing said nut along said threaded bolt pulling the chain further into said tensioning chamber;
6. Placing a cover plate over said threaded bolt, said locking tab, and said chain pole thereby covering and securing the nut threaded over the bolt in front of the washer and the end link of the chain from tampering by covering them with said cover plate;
7. Passing a shackle of a padlock or other locking mechanism through said slot thereby blocking the removal of the cover plate with a padlock or other locking mechanism such as any corded or tabbed locking means for locking a usual padlock tab; and
8. Locking said padlock creating a secure placement of the cover plate over said threaded bolt, said locking tab, and said chain pole.

A first advantage of the platform storage security device is the adjustability of securing various types, kinds, configurations, volumes of materials, construction materials, and tools. The chain, cable, cord, or strap can be adjusted in length, or a different length used, to encase and secure by binding together material and products stored on a platform, pallet, or crates.

A second advantage of the platform storage security device is enabling the ability to secure quickly and inexpensively nearly any amount or quantities of materials, tools, or products.

The invention has been described by way of examples only. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the claims.

Although the invention has been explained in relation to various embodiments, it is to be understood that many other possible modifications and variations can be made without departing from the spirit and scope of the invention.

The invention claimed is:

1. A platform storage security device comprising a security box having a back panel having a top end opposite a bottom end and a left side opposite a right side, a left wall having a first flat edge connected lengthwise to said left side and a first "L" shaped edge having a first flat length and a first elevated length with a first triangular plate having a first edge, a second edge, and a third edge attached lengthwise with said first edge positioned over at least half of said first flat length with a first elevated wall attached along said second edge, and a second elevated wall attached along said third edge connected to said first elevated wall, a right wall having a second flat edge connected lengthwise to said right side and a second "L" shaped edge having a second flat length and a second elevated length with a second triangular plate having a fourth edge, a fifth edge, and a sixth edge attached lengthwise with said fourth edge positioned over at least half of said second flat length with a third elevated wall attached along said fourth edge, and a fourth elevated wall attached along said sixth edge connected to said third elevated wall, a top plate attached at a right angle to said back panel at said top end, a tensioning chamber having a washer with a bolt hole attached internally proximal to one end attached lengthwise to said top plate perpendicular to said back panel, a locking tab having a slot positioned in a first center of said back panel at a clockwise angle between five and eighty-five degrees, a chain pole attached perpendicular proximate to said bottom end, a cover plate having a top edge, a bottom edge, a locking tab slot through said cover plate at a second center, a bolt hole through said cover plate proximal to said top edge, and a chain pole hole through said cover plate proximate to said bottom edge, a chain having a free end opposite a tightening end comprising a chain tensioner having a threaded bolt dimensioned to pass through said washer extending perpendicular therefrom, and a threaded nut dimensioned to fit within said tensioning chamber but not through said bolt hole for advancing along said threaded bolt.

2. The platform storage security device of claim 1 further comprising a padlock.

3. A method of securing a stack of materials on a platform using a platform storage security device comprising the following steps:

wrapping a chain having an end link at a free end and a threaded bolt and an adjustable chain tensioner at an opposing end completely around said stack of materials so that said free end and said opposing ends are proximal to each other and wrapped around said stack of materials;

placing a security box having a tensioning chamber, a locking tab with a slot therethrough, and a chain pole over an edge of said stack of materials such that said tension chamber, locking tab, and chain pole are perpendicular to said stack of materials pointing away therefrom;

placing said end link of said chain over said chain pole of said security box;

inserting said threaded bolt into and through said tensioning chamber of said security box;

threading a nut along said threaded bolt to tighten said chain;

placing a cover plate over said threaded bolt, said locking tab, and said chain pole;

passing a shackle of a padlock through said slot; and locking said padlock.

* * * * *